US007784965B2

(12) United States Patent
Jiang et al.

(10) Patent No.: US 7,784,965 B2
(45) Date of Patent: Aug. 31, 2010

(54) SOLID STATE LIGHT ILLUMINATOR

(75) Inventors: Wen-Jang Jiang, Miao-Li Hsien (TW); Hung-Kuang Hsu, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 140 days.

(21) Appl. No.: 12/168,780

(22) Filed: Jul. 7, 2008

(65) Prior Publication Data

US 2009/0161362 A1 Jun. 25, 2009

(30) Foreign Application Priority Data

Dec. 25, 2007 (CN) ..... 2007 1 0203400

(51) Int. Cl.
*F21V 33/00* (2006.01)

(52) U.S. Cl. ..... 362/192; 362/640; 362/158

(58) Field of Classification Search ..... 362/192, 362/640, 245, 158, 189
See application file for complete search history.

(56) References Cited

U.S. PATENT DOCUMENTS 5,264,997 A 11/1993 Hutchisson et al.
5,600,225 A 2/1997 Goto
2007/0152642 A1 7/2007 Franklin
2007/0201223 A1* 8/2007 Long et al. ..... 362/157
2008/0054814 A1* 3/2008 Deppe et al. ..... 315/192

FOREIGN PATENT DOCUMENTS

| | | | |
|---|---|---|---|
| CN | 101089642 | A | 12/2007 |
| CN | 101490772 | A | 7/2009 |
| DE | 202007012248 | U1 | 10/2007 |
| EP | 1845755 | A2 | 10/2007 |
| EP | 1885163 | A1 | 2/2008 |
| WO | WO9602970 | A1 | 2/1996 |
| WO | WO 01/16995 | A1 | 3/2001 |

OTHER PUBLICATIONS

Michael S. Shur et al., Solid-State Lighting: Toward Superior Illumination, Proceedings of the IEEE, 1691-1703, vol. 93, No. 10, Oct. 2005.

* cited by examiner

*Primary Examiner*—Laura Tso
(74) *Attorney, Agent, or Firm*—Andrew C. Cheng

(57) ABSTRACT

A solid state light illuminator includes a solid state lighting element, a primary coil, and a secondary coil. The secondary coil and the solid state lighting element cooperatively form a circuit. The secondary coil couples electromagnetically with the primary coil. The primary coil is adapted for electrically connecting to an AC power source to generate an alternating magnetic field. The alternating magnetic field generates an induced electromotive force in the secondary coil to apply an electrical current to the solid state lighting element.

15 Claims, 3 Drawing Sheets

SOLID STATE LIGHT ILLUMINATOR

BACKGROUND

1. Field of the Invention

The present invention relates to a solid state light illuminator incorporating a solid state lighting element as a light source.

2. Description of Related Art

In recent years, light emitting diodes (LEDs) have been widely used as light source in many fields, such as street lamps, submarine lamps, billboard lamps, and traffic lights. However, the light source has a limited life, and in some situations, such as in underwater applications, the lamps need to be maintained or replaced regularly. However, the lamps are usually connected to a power source by wires such that maintenance or replacement of the lamps becomes extraordinarily complicated and difficult, particularly, when the lamps are used underwater or in damp circumstances.

Therefore, a new illuminator is desired to overcome the above-described problems.

SUMMARY

According to an embodiment of the present invention, a solid state light illuminator includes a solid state lighting element, a primary coil, and a secondary coil. The secondary coil and the solid state lighting element cooperatively form a circuit. The secondary coil couples electromagnetically with the primary coil. The primary coil is configured to electrically connect to an alternating current (AC) power source to generate an alternating magnetic field. The alternating magnetic field generates an induced electromotive force in the secondary coil to apply an electrical current to the solid state lighting element.

Other advantages and novel features of the present invention will be drawn from the following detailed description of the embodiments and the drawings.

DETAILED DESCRIPTION OF THE EMBODIMENTS

Figure 1:
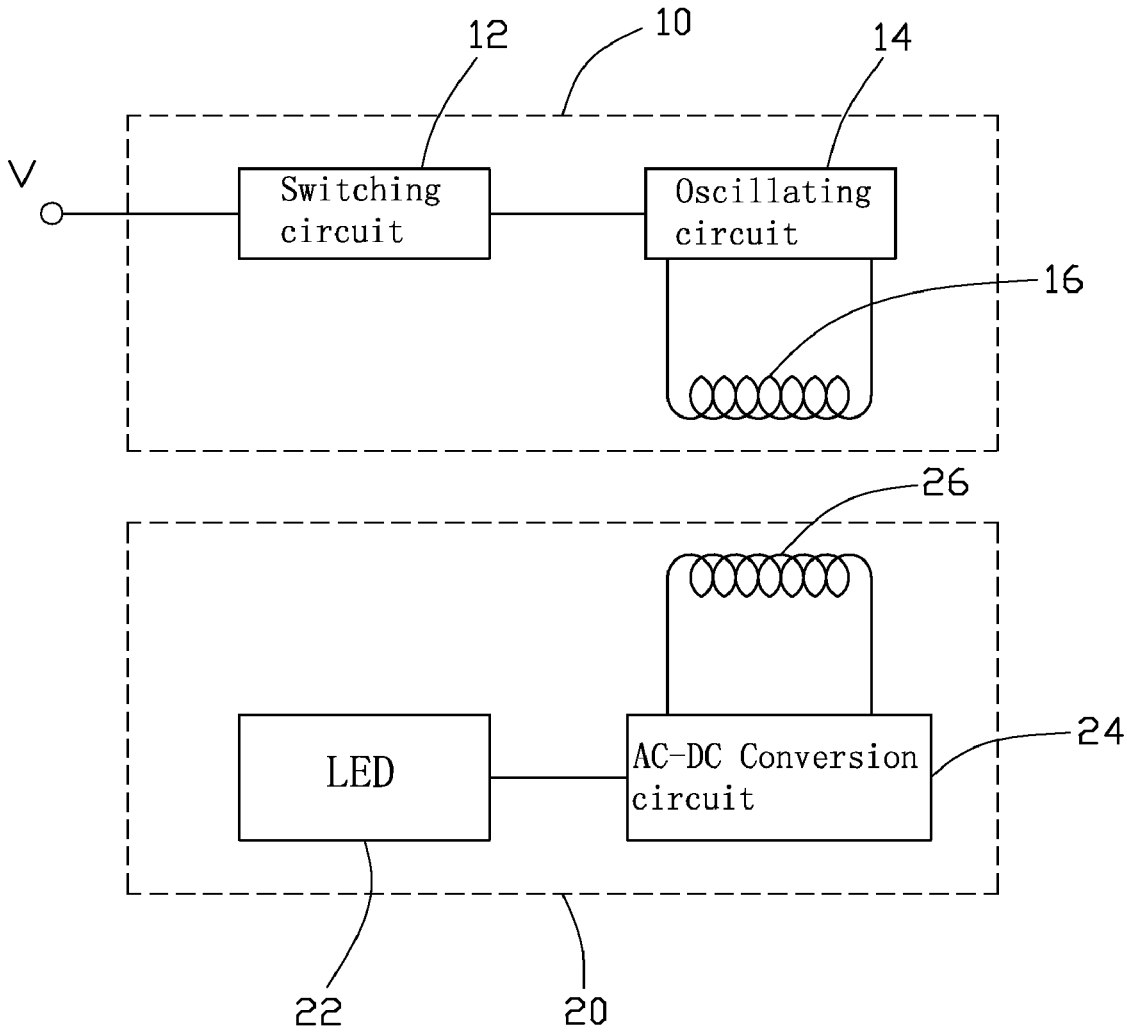
FIG. 1 is a block diagram of one embodiment of a circuit construction of a solid state light illuminator.

Referring to FIG. 1, a solid state light illuminator (not labeled) includes a fixing part 10 and a lighting part 20.

The fixing part 10 is configured for connecting the lighting part 20 to an alternating current (AC) power source (not shown). The fixing part 10 includes a switching circuit 12, an oscillating circuit 14, and a primary coil 16. The switching circuit 12, the oscillating circuit 14, and the primary coil 16 together form a circuit. Typically, the power source has a voltage of 110 V or 220V. The switching circuit 12 is electrically connected to the power source. The oscillating circuit 14 electrically connects the switching circuit 12 and the power source. The switching circuit 12 is configured for turning the power source supplied to the oscillating circuit 14 on or off.

The lighting part 20 includes a solid state lighting element 22, an alternating current-direct current (AC-DC) conversion circuit 24 and a secondary coil 26. The solid state lighting element 22, the AC-DC conversion circuit 24, and the secondary coil 26 cooperatively form a circuit. In one embodiment, the solid state lighting element 22 is a light emitting diode (LED) 22. The secondary coil 26 couples electromagnetically with the primary coil 16. The AC-DC conversion circuit 24 electrically connects the secondary coil 26 and the LED 22.

During operation, an alternating current is applied to the primary coil 16 by the power source. According to Maxwell's electromagnetic field theory, a magnetic field appears during the change of an electric field. An alternating magnetic field is generated in the primary coil 16. The alternating magnetic field generates an induced electromotive force in the secondary coil 26 because the secondary coil is electromagnetically coupled with the primary coil 16. Since the LED 22, the AC-DC conversion circuit 24, and the secondary coil 26 cooperatively form a complete circuit, an alternating current arises in the secondary coil 26 from the induced electromotive force. The AC-DC conversion circuit 24 converts the alternating current of the secondary coil 26 into direct current. The direct current outputted from the AC-DC conversion circuit 24 is supplied to the LED 22 causing the LED 22 to emit light.

The primary coil 16 and the secondary coil 26 are in an electromagnetic coupling state, but are not electrically connected to each other. In other words, an electrically insulating interface is formed between the fixing part 10 and the lighting part 20. The fixing part 10 and the lighting part 20 are electrically isolated from each other. When the solid state lighting element needs to be replaced, the fixing part 10 and the lighting part 20 can be separated and the lighting part 20 of the illuminator can be easily accessed and replaced. Thus, maintenance or replacement of the illuminator is easy and convenient.

Figure 2:
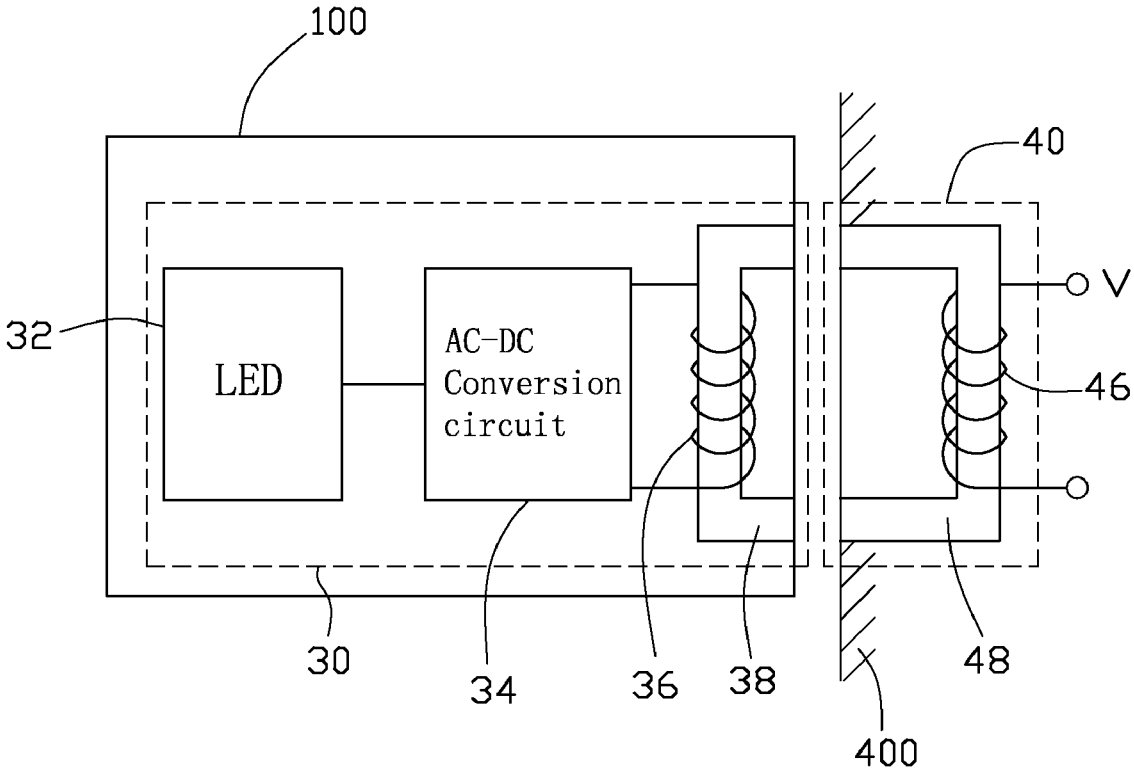
FIG. 2 is one embodiment of the solid state light illuminator applied to a billboard.

FIG. 2 is one embodiment of the solid state light illuminator as applied to a billboard. The solid state light illuminator includes a fixing part 40 and a lighting part 30. The fixing part 40 can be fixedly positioned on a platform 400, such as a wall. The fixing part 40 includes a primary iron core 48 and a primary coil 46 wound around the primary iron core 48. The primary coil 46 is electrically connected to a power source. The power source typically has a voltage of 110V and a frequency of 60 Hz. The lighting part 30 is arranged behind a light guide plate 100. The lighting part 30 includes a plurality of LEDs 32 used for generating light, a secondary iron core 38, a secondary coil 36 wound around the secondary iron core 38, and an AC-DC conversion circuit 34 electrically connected between the secondary coil 36 and the LEDs 32. The primary iron core 48 and the secondary iron core 38 face each other. During operation, the primary coil 46 and the secondary coil 36 are in an electromagnetic coupling state, but are not electrically connected to each other. The distance between the primary iron core 48 and the secondary iron core 38 is typically around 0.1-0.3 mm. The primary iron core 48 and the secondary iron cores 38 are configured for increasing the magnetic induction of the primary coil 46 and the secondary coil 36, respectively. When supplying the primary coil 46 with an alternating current at the prescribed voltage and frequency, an induced electromotive force is generated in the secondary coil 36 to light the LEDs 32.

Figure 3:
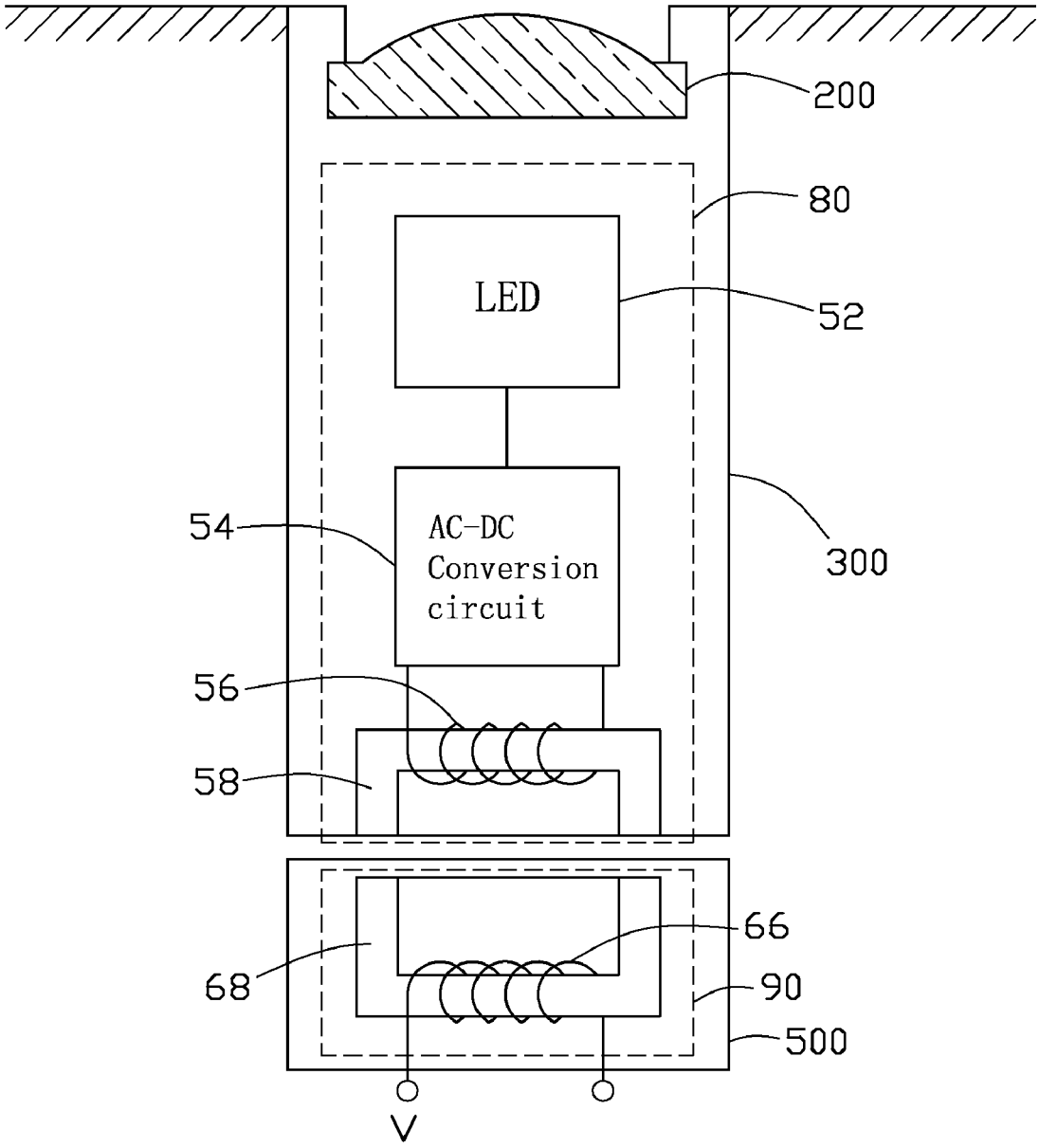
FIG. 3 is one embodiment of the solid state light illuminator used as a submarine lamp.

FIG. 3 is one embodiment of the solid state light illuminator used as a submarine lamp. In this embodiment, the illuminator is arranged at the bottom of a natatorium. The illuminator includes a fixing part 90 and a lighting part 80. The fixing part 90 and the lighting part 80 are each sealed in a fixing part shell 500 and lighting part shell 300, respectively, which are made of waterproof and insulating material. The fixing part 90 is embedded in the ground. The lighting part 80 is positioned over the fixing part 90 and submerged underwater. The fixing part 90 includes a primary iron core 68 and a primary coil 66. The lighting part 80 includes a secondary iron core 58 facing the primary iron core 68, a secondary coil 56, an AC-DC conversion circuit 54, and at least one LED 52. The lighting part shell 300 includes an opening (not labeled) at one end. A lens 200 is positioned at the opening of the lighting part shell 300 thereby forming a seal at the opening. At least one LED 52 faces the lens 200. When an alternating current is supplied to the primary coil 66, an induced electromotive force is generated in the secondary coil 56 to light the at least one LED 52. The light of the at least one LED 52 travels through the lens 200 to light the natatorium.

It is understood that the invention may be embodied in other forms without departing from the spirit thereof. Thus, the present example and embodiments are to be considered in all respects as illustrative and not restrictive, and the invention is not to be limited to the details given herein.

What is claimed is:

1. A solid state light illuminator, comprising:

a primary coil configured to electrically connect to an alternating current power source to generate an alternating magnetic field;

a secondary coil coupling electromagnetically with the primary coil;

a solid state lighting element electrically connected to the secondary coil, wherein the alternating magnetic field generated by the primary coil, generates an induced electromotive force in the secondary coil to apply an electrical current to the solid state lighting element; and a first iron core and a second iron core, wherein the primary coil is wound around the first iron core and the secondary coil is wound around the second iron core;

wherein the first iron core and the second iron core are in electrically non-contacting state, and a distance between the first iron core and the second iron core is in a range of 0.1-0.3 mm.

2. The solid state light illuminator of claim 1, further comprising an alternating current-direct current conversion circuit that electrically connects the solid state lighting element and the secondary coil.

3. The solid state light illuminator of claim 1, further comprising an oscillating circuit that electrically connects the alternating current power source and the primary coil.

4. The solid state light illuminator of claim 3, further comprising a switching circuit that electrically connects the alternating current power source and the oscillating circuit.

5. The solid state light illuminator of claim 1, further comprising a primary shell and a secondary shell each made of waterproof and insulating material, wherein the primary coil is sealed in the primary shell, and the secondary coil and solid state lighting element are sealed in the secondary shell.

6. The solid state light illuminator of claim 5, further comprising a lens, wherein the solid state light illuminator is arranged underwater; the secondary shell defining an opening at one end; the lens positioned at the opening thereby forming a seal at the opening; the solid state lighting element received in the secondary shell and facing the lens.

7. The solid state light illuminator of claim 1, wherein the solid state lighting element comprises at least one light emitting diode.

8. A solid state light illuminator, comprising:

a first iron core;

a primary coil wound around the first iron core and configured to electrically connect to an alternating current power source to generate an alternating magnetic field;

a solid state lighting element;

a second iron core;

a secondary coil wound around the second iron core and coupled electromagnetically with the primary coil, wherein the alternating magnetic field generated by the primary coil generates an induced electromotive force in the secondary coil to apply an electrical current to the solid state lighting element causing the solid state lighting element to emit light; and an alternating current-direct current conversion circuit electrically connecting the solid state lighting element and the secondary coil to form a circuit;

wherein the first iron core and the second iron core are in electrically non-contacting state, and a distance between the first iron core and the second iron core is in a range of 0.1-0.3 mm.

9. The solid state light illuminator of claim 8, further comprising an oscillating circuit that electrically connects the alternating current power source and the primary coil.

10. The solid state light illuminator of claim 9, further comprising a switching circuit that electrically connects the alternating current power source and the oscillating circuit.

11. The solid state light illuminator of claim 8, further comprising a primary shell and a secondary shell each made of waterproof and insulating material, wherein the primary coil is sealed in the primary shell, and the secondary coil and solid state lighting element are sealed in the secondary shell.

12. The solid state light illuminator of claim 11, further comprising a lens, wherein the solid state light illuminator is arranged underwater; the secondary shell defining an opening at one end, the lens positioned at the opening thereby forming a seal at the opening; the solid state lighting element received in the secondary shell and facing the lens.

13. The solid state light illuminator of claim 8, wherein the solid state lighting element comprises at least one light emitting diode.

14. A solid state light illuminator, comprising:

a primary coil configured to electrically connect to an alternating current power source to generate an alternating magnetic field;

a secondary coil coupling electromagnetically with the primary coil;

a solid state lighting element electrically connected to the secondary coil, wherein the alternating magnetic field generated by the primary coil, generates an induced electromotive force in the secondary coil to apply an electrical current to the solid state lighting element; and a primary shell and a secondary shell each made of waterproof and insulating material, wherein the primary coil is sealed in the primary shell, and the secondary coil and solid state lighting element are sealed in the secondary shell.

15. The solid state light illuminator of claim 14 further comprising a lens, wherein the solid state light illuminator is arranged underwater; the secondary shell defining an opening at one end; the lens positioned at the opening thereby forming a seal at the opening; the solid state lighting element received in the secondary shell and facing the lens.

* * * * *